United States Patent [19]

Massey et al.

[11] 4,286,111

[45] Aug. 25, 1981

[54] APPARATUS FOR INTERCONNECTING A POWER SUPPLY TO AN ELECTRODE WITHIN A CHAMBER CONTAINING FLUID MAINTAINED AT A HIGH TEMPERATURE AND PRESSURE

[75] Inventors: Lester G. Massey, Moreland Hills, Ohio; David A. George, Park Forest, Ill.; Robert I. Brabets, Lombard, Ill.; William A. Abel, Joliet, Ill.

[73] Assignee: CNG Research Company, Cleveland, Ohio

[21] Appl. No.: 127,737

[22] Filed: Mar. 6, 1980

[51] Int. Cl.[3] ..... B02C 19/18; H01B 17/30; H05B 3/60

[52] U.S. Cl. ..... 174/15 BH; 13/20; 174/18; 219/288; 219/294; 241/1; 241/301; 277/22; 422/199; 422/208

[58] Field of Search ..... 174/15 BH, 15 CA, 18; 219/288, 289, 290, 294; 241/1, 17, 21, 23, 38, 65, 301; 277/22; 422/199, 208, 242, 309; 13/20, 25

[56] References Cited

U.S. PATENT DOCUMENTS

| | | | |
|---|---|---|---|
| 2,323,051 | 6/1943 | Junker et al. | 13/25 X |
| 2,351,490 | 6/1944 | Cooper | 13/25 X |
| 3,128,325 | 4/1964 | Andersen et al. | 13/20 |
| 3,578,416 | 5/1971 | Pope | 422/199 X |

*Primary Examiner*—Laramie E. Askin

*Attorney, Agent, or Firm*—Allegretti, Newitt, Witcoff & McAndrews, Ltd.

[57] ABSTRACT

An apparatus for connecting a power supply to an electrode within a high pressure, high temperature vessel is disclosed. The apparatus includes a conductor extending through the vessel such that the net force exerted upon the conductor by the vessel pressure is negligible. An elastomeric material seals the vessel conductor interface and the apparatus cools the sealing material to avoid softening thereof.

7 Claims, 3 Drawing Figures

10
12
14
16
18
20
22
24
26
28
30
31
32
34
36
38
42
44
46
48
50
52
56
58
59
67
3

APPARATUS FOR INTERCONNECTING A POWER SUPPLY TO AN ELECTRODE WITHIN A CHAMBER CONTAINING FLUID MAINTAINED AT A HIGH TEMPERATURE AND PRESSURE

BACKGROUND OF THE INVENTION

The present invention relates generally to a system for the comminution of coal and more particularly to an electrical interconnection for passing a current to an electrode within the high pressure, high temperature vessel of an explosive comminution system.

Explosive comminution of coal involves the heating and pressurization of a coal-water slurry within a vessel and the subsequent, rapid adiabatic expansion of the heated and pressurized slurry. One method of heating the slurry is electrical. An electrode, positioned within the vessel and submerged in the slurry, permits a current to pass through the slurry from the electrode to the vessel wall. The passage of current through the slurry produces, by resistance heating, a heated slurry.

The presently available apparatus for interconnecting an electrode to a power supply includes a single conductor extending through an opening in the vessel wall and terminating at the electrode. A ceramic seal closes the opening about the conductor.

These interconnection apparatus become unacceptable when the pressure within the vessel is raised above a predetermined level, e.g., above the critical pressure of the slurry liquid. The vessel pressure operates upon the conductor, creating a force imbalance which tends to push the conductor out of the vessel. The resulting stress on the ceramic seal causes deterioration and cracking thereof in a relatively short period of time.

The pressure imbalance problem is particularly acute in a large scale operation where large conductors are required. As the cross-sectional area of the conductor increases by a factor, the force required to maintain the conductor within the vessel increases in proportion to the square of the factor. Thus, if the area is increased twofold, the securing force must be increased fourfold.

In addition to having a tendency to crack when subject to stress, certain ceramic seals have a measurable permeability to fluids at a high pressure and temperature. With fluid permeation, the seal is substantially weakened and cracks therein develop more quickly.

Continuous cycling of the pressure and temperature conditions within the vessel further increases the likelihood of leakage and cracking. This is particularly true when the slurry is highly corrosive or chemically active. The present invention is designed to improve upon these and other aspects of providing an electrical connection to the interior of a high temperature, high pressure vessel.

SUMMARY OF THE INVENTION

It is thus an object of the present invention to provide an improved apparatus for interconnecting a power supply and an electrode within, a high pressure, high temperature vessel.

Another object of this invention is an electrical interconnection apparatus operable in a high pressure and high temperature environment.

Still another object of the present invention is to provide an apparatus for passing a current to a heating electrode positioned within a high temperature, high pressure coal comminution vessel wherein an elastomeric, non-cracking, chemically resistant seal is utilized and protected against the effects of the high temperature, high pressure operation.

A further object of this invention is an inexpensively manufactured and readily maintained electrical interconnection apparatus for use in a high pressure, high temperature system.

In a prinicipal aspect, the present invention provides an improved electrical interconnection apparatus for passing a current into a high pressure, high temperature vessel. A preferred application of the electrical interconnection apparatus is to pass electrical energy to a vessel containing a coal-water slurry at or above critical temperature and pressure conditions.

The interconnection apparatus of the present invention includes a pair of housings, secured to the vessel and extending outwardly therefrom, and a conductor passing therethrough. The conductor is electrically, and preferably physically, connected to the heating electrode within the vessel. The external ends of the housings are sealed by an elastomeric sealing material to provide a substantially impermeable seal.

The interconnection apparatus further includes a system for cooling the housings and seals. The cooling system, in combination with the physical displacement of the seals from the vessel, substantially avoids thermal softening of the sealing material.

The extension of the conductor across the vessel substantially eliminates any pressure imbalance problem. The forces exerted on the conductor by the vessel pressure counterbalance, such that the net force is negligible.

These and other features, object and advantages of the present invention are set forth or are apparent in the following description of a preferred embodiment of the present invention.

BRIEF DESCRIPTION OF THE DRAWING

A preferred embodiment of the present invention is described herein with reference to the drawing wherein.

DESCRIPTION OF A PREFERRED EMBODIMENT

Figures 1, 2, 3:
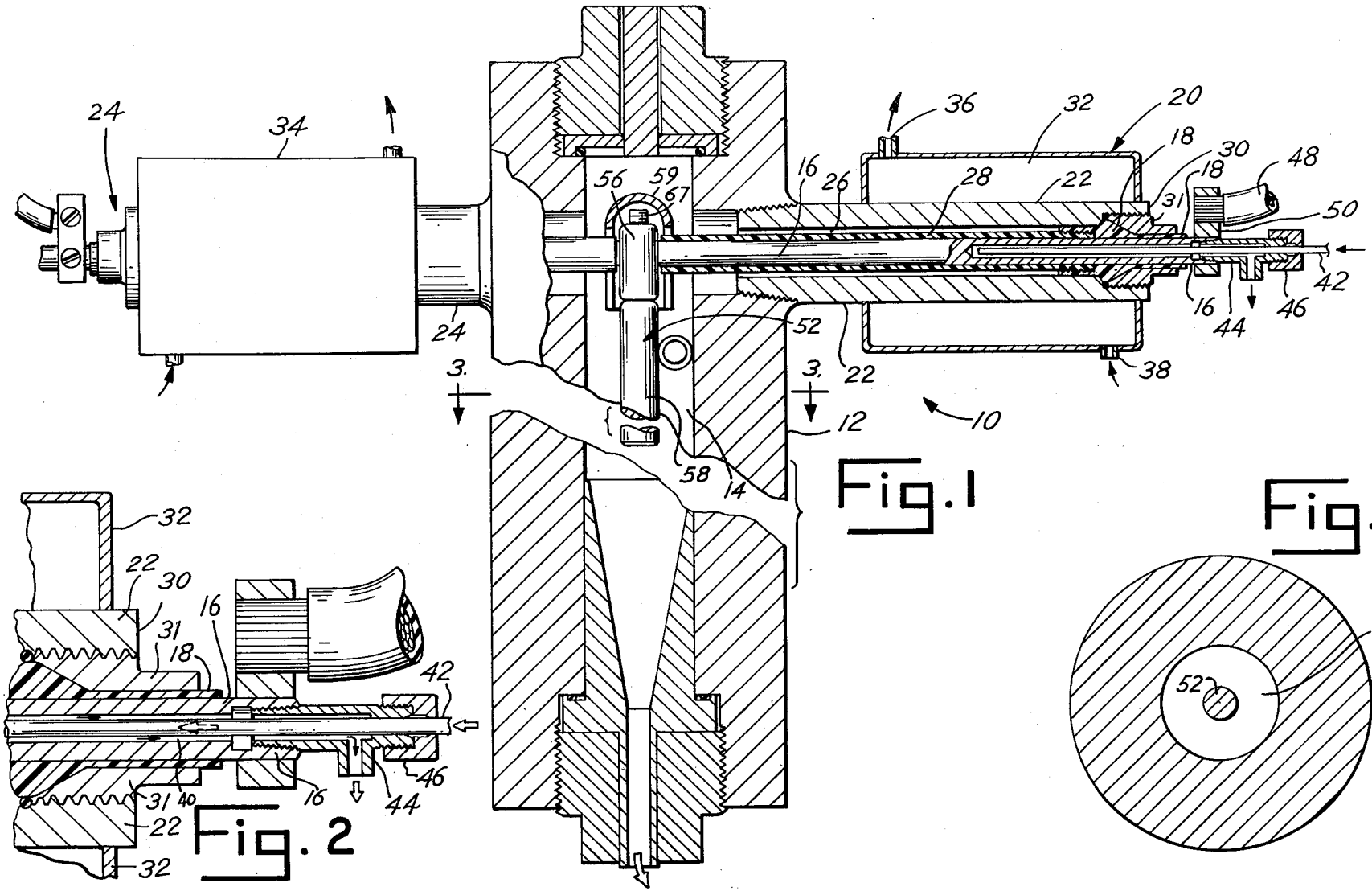
FIG. 1 is a side elevational, partial cross-sectional view of a high pressure, high temperature vessel incorporating a preferred embodiment of the present invention.
FIG. 2 is a partial, enlarged cross-sectional view of a portion of the preferred embodiment shown in FIG. 1.
FIG. 3 is a cross-sectional view of the high temperature, high pressure vessel shown in FIG. 1 taken along 3—3.

Referring to the drawing, a preferred embodiment of the present invention is shown as an interconnection apparatus, generally designated 10, for passing a current into a high pressure, high temperature vessel 12, which defines an interior chamber 14. The chamber 14 is adapted to contain a fluid, such as a gas, liquid or slurry. A particular application of the interconnection apparatus 10 relates to an explosive comminution system in which the chamber 14 contains a coal-fluid slurry, preferably coal-water, above critical temperature and pressure conditions.

Such an explosive comminution system is fully described in the copending application of Massey et al., Ser. No. 127,740, filed Mar. 6, 1980 and titled "Method for Separating Undesired Components From Coal by An Explosion Type Comminution Process", the teachings of which are incorporated by reference herein.

Briefly, the explosive comminution of coal is accomplished by creating strong internal stresses within the pores of the coal. These stresses are created by forcing a liquid into the pores of the coal particles under supercritical pressures and supercritical temperatures. The pressure imposed on the coal particles is then rapidly reduced, resulting in substantially instantaneous expansion of the fluid within the pores thereby causing the coal particles to explode.

A slurry of coal and water is continuously heated in the vessel 12 to maintain the supercritical temperature condition. Referring to FIG. 1, heating is achieved in this preferred embodiment by an electrode 52 in the form of a rod 58 positioned within the vessel 12 and submerged in the slurry. Connected to a power supply, the electrode 52 provides an electric current that flows through the slurry, from the electrode 52 to the vessel 12, to resistively heat the slurry. The interconnection apparatus 10 connects the electrode 52 and a power supply, generally designated 48, located outside the high temperature and high pressure environment.

The interconnection apparatus 10 includes a pair of housings 22, 24, secured to the vessel 12. As shown, the housings 22, 24 are threaded at one end for receipt thereof by openings in the vessel 12. In this preferred embodiment, the housings 22, 24 are oppositely secured, extending parallel and radially outwardly from the vessel 12.

A pass-though conductor 16 extends through and beyond the housings 22, 24. In this preferred embodiment, the conductor 16 extends through the approximate center of the vessel 12. The size and composition of the conductor 16 will vary depending upon the chemical nature of the slurry and the amount of current to be conducted. Preferred materials of construction include copper and stainless steel.

The conductor 16 is electrically connected to the heating electrode 52 within the vessel 12. In this preferred embodiment, the conductor 16 engages an opening in an upper end 56 of the electrode 52. The conductor 16 is secured with respect to the electrode 52 by a locking bolt 67 adapted to engage the conductor 16. The external ends 40 of the conductor 16, which extend beyond the housings 22, 24, are connected to the power supply 48 by a coupling 50.

Within the housings 22, 24, the conductor 16 is enclosed by an electrical insulator 28 to substantially avoid current flow between the conductor 16 and the housings 22, 24. A preferred insulating material is fused alumina.

The insulator 28 avoids resistant heating of the slurry in the cavity 26 between the conductor 16 and housings 22, 24. Such heating would cause coal agglomeration due, in part, to the lack of dynamic slurry flow within the cavity 26. The insulator 28 also avoids electrical arcing and the destructive effects thereof.

In this preferred embodiment, the conductor 16 is a cylindrical rod. The insulator 28 is a corresponding cylindrical enclosing tube.

For clarity, only the details of the housing 22 are shown; it should be understood, however, that the housing 24 is substantially identical. Referring to FIGS. 1 and 2, the external, open end 30 of the housing 22 is closed by a sealing ring 18 and an expansion-type retaining nut 31. The open end 30 of the housing 22 is threaded to receive the retaining nut 31.

As shown, the sealing ring 18 interposes the retaining nut 31 and the housing 22, insulator 28 and conductor 16. The retaining nut 31 forcibly deforms the sealing ring 18 against the housing 22, insulator 28 and conductor 16 to provide a substantially leak-proof seal.

The sealing ring 18 has a substantially cylindrical opening therethrough to receive the conductor 16. This opening is enlarged at one end thereof for receipt of the insulator 28.

The sealing ring 18 is preferably an elastomeric, corrosion and chemical resistant material, such as natural or synthetic rubber, and some thermoplastics, such as are used in low pressure, low temperature sealing applications. A preferred material is a polycarbonate, such as the material marketed by E. I. duPont De Nemours & Company under the tradename LEXAN.

The physical and electrical connection between the conductor 16 and electrode 52 is substantially enclosed by a bell-shaped cover 59. The cover 59 is slotted to fit over the conductor 16. Preferably, the cover 59 is a non-corrosive, non-conductive material, such as fused alumina.

The cover 59 substantially avoids build-up or agglomeration of the slurry solids about the connection. The cover 59 also provides an electrical shield to substantially avoid continuous, direct heating of the slurry in the substantially dead space near the top of the chamber 14.

Referring again to FIG. 1, the interconnection apparatus 10 also includes cooling means, generally designated 20, for cooling the housings 22, 24 and the sealing rings 18. In this preferred embodiment, the cooling means includes cooling chamber 32, 34, partially enclosing the housings 22, 24, respectively. A continuous stream of cooling fluid is circulated from entry 38 to exit 36 through the chamber 32, 34 to dissipate heat within the housings 22, 24.

The placement of the sealing rings 18, i.e., physically displaced or removed from the chamber 14 by the housings 22, 24 and the cooling means 20 cooperate to define temperature control means for maintaining the temperature of the sealing rings 18. The temperature and flow rate of the fluid in the cooling means 20 maintain the sealing rings 18 at a temperature below the plastic flow temperature thereof, to substantially avoid softening of the elastomeric material and prevent the sealing rings 18 from being, in effect, extruded out the open end 30 of housings 22, 24.

In this preferred embodiment, the external ends 40 of the conductor 16 are hollow and threaded. The cooling means 20 further includes a tube 42, having a special "tee"44, as shown in FIG. 2, to provide cooling fluid egress, which is inserted into each hollow end 40 and secured thereto by a threaded locking and fluid sealing member 46. A second cooling stream is circulated through and about the tube 42 to further cool the sealing rings 18. The heat dissipated by the second cooling stream includes primarily heat produced by current passage through the conductor 16 and vessel heat conductively transmitted along the conductor 16 to the external end 40 thereof.

The extension of the conductor 16 across the vessel 12 and beyond the housings 22, 24 avoids the pressure imbalance problem experienced with a single conductor, terminating at the electrode 52. The orientation of the conductor 16 is substantially symmetric with respect to the vessel 12, such that pressures exerted thereon counteract and counterbalance. As a result, only a minimal, tolerable net force is exerted on the sealing rings 18.

A single preferred embodiment of the present invention has been disclosed herein. It is to be understood that modifications and changes can be made without departing from the true scope and spirit of the present invention as set forth and defined by the following claims, to be interpreted in light of the foregoing specification. For example, three conductors 16, extending outwardly from the electrode 52 and equally angularly displaced from the others, could be utilized. Such an arrangement would similarly avoid any substantial pressure imbalance. The invention could alternatively be used in connection with low temperature (i.e. cryogenic) high pressure applications. In such applications, a relatively warm fluid is circulated through the tee 44 of tube 42 to heat the sealing rings 18 such that the sealing rings 18 are maintained in an elastic state and hardening thereof is avoided. Thus, this invention is to be limited only by the following claims and their equivalents.

What is claimed is:

1. An apparatus for passing an electrical current to an electrode within a vessel, said vessel containing a fluid at a high temperature and a high pressure, comprising, in combination:

at least a pair of housings secured to said vessel and extending outwardly therefrom, each housing having an external open end;

at least a single conductor passing through said housings and said vessel and extending beyond said external open ends, said conductor being electrically connected to said electrode and having an orientation with respect to said vessel whereby a pressure imbalance upon said conductor is substantially avoided;

sealing means for sealing said external open ends of said housings about said conductor to substantially avoid leakage of said fluid therethrough, said sealing means including an elastomeric seal; and cooling means for cooling said sealing means;

said housings and said cooling means cooperatively defining temperature control means for maintaining the temperature of said elastomeric seal to substantially avoid thermal softening thereof.

2. An apparatus, as claimed in claim 1, wherein said electrode has an opening therein receiving said conductor, said conductor being secured therein.

3. An apparatus, as claimed in claim 1, further comprising an insulator partially enclosing said conductor to substantially avoid passage of said electrical current between said conductor and said housings.

4. An apparatus, as claimed in claim 1, wherein said thermoplastic sealing ring.

5. An apparatus, as claimed in claim 4, wherein said thermoplastic sealing ring defines an opening therethrough receiving said conductor.

6. An apparatus, as claimed in claim 5, further comprising a retaining nut threadable into said external open end of said housing, said retaining nut forcing said thermoplastic sealing ring against said housing and said conductor.

7. An apparatus for passing an electrical current to an electrode within a vessel, said vessel containing a fluid at a high pressure, comprising in combination:

at least a pair of housings secured to said vessel and extending outwardly therefrom, each housing having an external open end;

at least a single conductor passing through said housings and said vessel and extending beyond said external open ends, said conductor being electrically connected to said electrode and having an orientation with respect to said vessel whereby a pressure imbalance upon said conductor is substantially avoided;

sealing means for sealing said external open ends of said housings about said conductor to substantially avoid leakage of said fluid therethrough, said sealing means including an elastomeric seal;

means for heating or cooling said sealing means; and said housings and said heating or cooling means cooperatively defining temperature control means for maintaining the temperature of said elastomeric seal to maintain the seal in an elastomeric state and to substantially avoid thermal softening or hardening thereof.

* * * * *